US008813587B2

(12) United States Patent
Van Druten et al.

(10) Patent No.: US 8,813,587 B2
(45) Date of Patent: Aug. 26, 2014

(54) DEVICE FOR STARTING A COMBUSTION ENGINE

(71) Applicant: DTI Group B.V., Eindhoven (NL)

(72) Inventors: Roell Marie Van Druten, Eindhoven (NL); Alexander Franciscus Anita Serrarens, Waalre (NL); Bas Gerard Vroemen, Eindhoven (NL)

(73) Assignee: DTI Group B.V., Eindhoven (NL)

( * ) Notice: Subject to any disclaimer, the term of this patent is extended or adjusted under 35 U.S.C. 154(b) by 0 days.

(21) Appl. No.: 13/709,724

(22) Filed: Dec. 10, 2012

(65) Prior Publication Data

US 2013/0091985 A1 Apr. 18, 2013

Related U.S. Application Data

(63) Continuation of application No. PCT/NL2011/050415, filed on Jun. 8, 2011.

(51) Int. Cl.

| | |
|---|---|
| ***F02N 15/06*** | (2006.01) |
| ***F02N 11/00*** | (2006.01) |
| ***F02N 15/02*** | (2006.01) |

(52) U.S. Cl.

USPC ..... 74/6; 123/179.25

(58) Field of Classification Search

USPC ..... 74/6, 7 C; 123/179.1, 179.22, 179.25, 123/179.28

See application file for complete search history.

(56) References Cited

U.S. PATENT DOCUMENTS

| | | | | |
|---|---|---|---|---|
| 2002/0082134 | A1 * | 6/2002 | Hirt et al. | 477/3 |
| 2007/0157899 | A1 * | 7/2007 | Seufert et al. | 123/179.25 |
| 2009/0255741 | A1 * | 10/2009 | Major et al. | 180/65.22 |
| 2012/0090569 | A1 * | 4/2012 | Van Druten et al. | 123/179.25 |
| 2013/0247858 | A1 * | 9/2013 | Van Druten et al. | 123/179.22 |

FOREIGN PATENT DOCUMENTS

| | | |
|---|---|---|
| EP | 1 486 666 | 12/2004 |
| FR | 2 729 435 | 7/1996 |
| WO | WO2010/068100 | 6/2010 |

* cited by examiner

*Primary Examiner* — Justin Krause
(74) *Attorney, Agent, or Firm* — Eric Karich

(57) ABSTRACT

A device has an output which is formed by a gearwheel that can be coupled to a gearwheel on a crankshaft of a combustion engine. The device comprises a first auxiliary drive source arranged as an electromotor, which is coupled to the output via a node. A first branch of a drive line is present between the electromotor and the node and a second branch of the drive line is present between the node and the output. The device further includes a second auxiliary drive source arranged as a flywheel which is coupled to the output via the node. A third branch is then present between the flywheel and the node.

10 Claims, 3 Drawing Sheets

DEVICE FOR STARTING A COMBUSTION ENGINE

CROSS-REFERENCE TO RELATED APPLICATIONS

This application for a utility patent is a continuation of a previously filed utility patent, now abandoned, having the application number PCT/NL2011/050415, filed 8 Jun. 2011.

DESCRIPTION

1. Field of the Invention

The invention relates to a device for starting a combustion engine.

2. State of the Art

A device of this type is known from FR 2729435 A. In this known device the auxiliary drive source is formed by a flywheel and the first clutch is formed by a friction clutch. The second auxiliary drive source is formed by an electromotor which can, for starting the combustion engine, be caused to be in engagement with a sliding gearwheel present on the crankshaft of a combustion engine. The flywheel can then assist the electromotor when the combustion engine is started, so that a lighter electromotor can suffice.

SUMMARY OF THE INVENTION

The invention is a device for starting a combustion engine, comprising an output which is coupled to a crankshaft of a combustion engine when the device collaborates with the combustion engine; a first auxiliary drive source which is coupled to the output via a node, where a first branch of a drive line is present between the first auxiliary drive source and the node and a second branch of the drive line is present between the node and the output; a second auxiliary drive source which is coupled to the output via the node, where a third branch is present between the second auxiliary drive source and the node; and a first clutch which is present in the first branch of the drive line It is an object of the invention to provide a device for starting a combustion engine in which the electromotor can be further unburdened. The device includes a second clutch which is present in the third branch and can couple the two auxiliary drive sources to each other. In consequence, the two auxiliary drive sources can be disengaged separately as a result of which the electromotor can be disengaged when the flywheel delivers power. This creates the possibility to start the combustion engine with the flywheel only, so that the electromotor needs to rev up only the flywheel or maintain it at the right speed and need not be briefly heavily loaded to start the combustion engine.

The first auxiliary drive source may be formed by an electromotor and the second auxiliary drive source is formed by a flywheel. Furthermore, the first clutch may be arranged as a freewheel bearing or centrifugal decoupling and the second clutch as a friction clutch.

An embodiment of the device may further include a third clutch which is arranged as a further freewheel bearing or a further centrifugal decoupling and which is present in the second branch. As a result, additional functionality may be created.

In lieu of coupling the device to a gearwheel present on the crankshaft it may also be desired to directly couple the device to the crankshaft. For this purpose, the device may further include a gear train which is present in the second branch between the node and the third clutch, where a first clutch section of the third clutch is connected to one of the gearwheels of the gear train and the other clutch section forms the output.

The output may be formed by a gearwheel and the device comprises a sliding link which is present between a sliding sleeve to which the gearwheel is fixed and a shaft over which the sliding sleeve can slide and which can bring the gearwheel into engagement with a further gearwheel present on the crankshaft. The third clutch may be present between the sliding sleeve and the gearwheel.

A still further embodiment of the device may further include a further sliding link which is present in the third branch between the node and the second clutch, which further sliding link is formed by gearwheels of a further gear train. As a result, in a compact manner and by using few component parts it is possible to create both a desired sliding link and a desired speed transforming gear between the flywheel and the output.

To maintain the flywheel at the right speed, the device can further be equipped with an electromotor that is connected to the flywheel.

In order to realize an even lighter configuration of the electromotor, a further embodiment of the device comprises a reduction gear in the first branch.

The invention likewise relates to a method for revving up or maintaining the speed of a flywheel that forms part of a device according to the invention. With respect to this method the invention is characterized in that the flywheel is revved up or maintained at the right speed by means of the auxiliary electromotor if the further clutch between the flywheel and the output is open.

The invention also relates to a method for revving up a flywheel that forms part of a device according to the invention. With respect to this method the invention is characterized in that the flywheel is revved up by closing the further clutch between the flywheel and the output or operating the further clutch in a slipping fashion.

Finally, the invention relates to a method for revving up a combustion engine that is connected to a device according to the invention. With respect to this method the invention is characterized in that the combustion engine is revved up by closing the further clutch between the flywheel and the output or operating the further clutch in a slipping fashion.

BRIEF DESCRIPTION OF THE DRAWINGS

The invention will be described in more detail based on examples of embodiment of the device according to the invention shown in the drawings while reference is made to the appended drawing figures, in which.

DETAILED DESCRIPTION OF THE DRAWINGS

Figure 1:
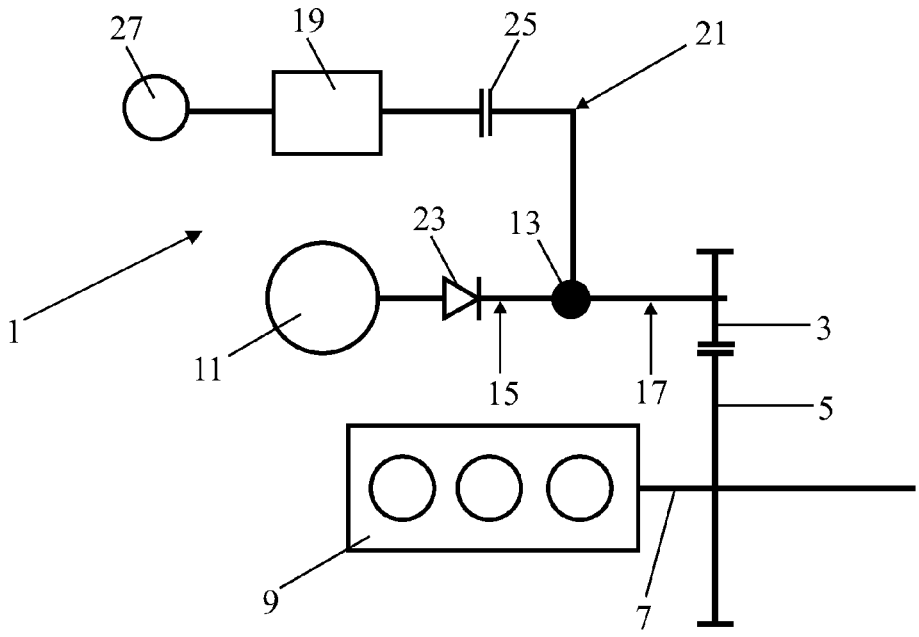
FIG. 1 shows a first embodiment of the device according to the invention.

FIG. 1 shows a first embodiment of the device for starting a combustion engine according to the invention. The device 1 has an output 3 which is formed by a gearwheel that can be coupled to a gearwheel 5 on a crankshaft 7 of a combustion engine 9.

The device comprises a first auxiliary drive source 11 which is arranged as an electromotor and which is coupled to the output via a node 13. is present A first branch 15 of a drive line is present between the electromotor and the node and a second branch 17 of the drive line is present between the node and the output.

The device further includes a second auxiliary drive source 19 which is arranged as a flywheel that is coupled to the output via the node 13. A third branch 21 is then present between the flywheel and the node.

In the first branch 15 is present a first clutch 23 which is arranged as a freewheel clutch and in the third branch is present a second clutch 25 which is arranged as a friction clutch.

The device further includes an auxiliary electromotor 27 which is connected to the flywheel so as to maintain the flywheel at the right speed or rev it up if necessary.

Figure 2:
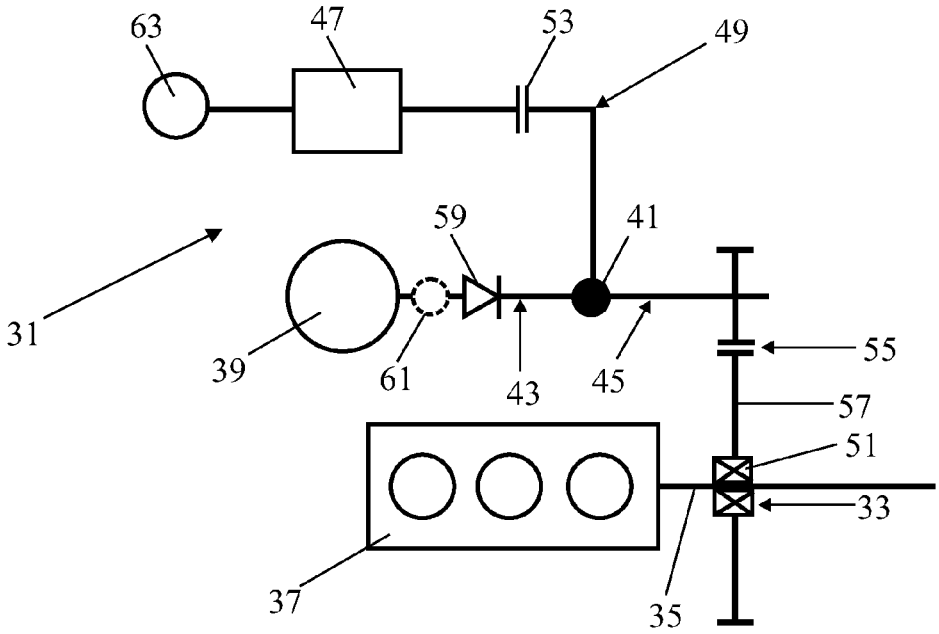
FIG. 2 shows a second embodiment of the device according to the invention.

FIG. 2 shows a second embodiment of the device for starting a combustion engine according to the invention. This device 31 has an output 33 that can be coupled to a crankshaft 35 of a combustion engine 37.

The device comprises a first auxiliary drive source 39 which is arranged as an electromotor and which is coupled to the output via a node 41. A first branch 43 of a drive line is then present between the electromotor and the node and a second branch 45 of the drive line is present between the node 41 and the output 33.

The device further includes a second auxiliary drive source 47 which is arranged as a flywheel that can be coupled to the output via the node 41. A third branch 49 is present between the flywheel and the node.

The first branch 43 includes a first clutch 59 which is arranged as a freewheel bearing and the third branch 49 includes a second clutch 53 which is arranged as a friction clutch. The second branch 45 includes a third clutch 51 which is also arranged as a freewheel bearing. A gear train 55 is present between this freewheel bearing and the node 41. The first bearing section of the freewheel bearing is connected to one of the gearwheels 57 of the gear train and the other bearing section forms the output 33.

A reduction 61 may be present between the first clutch 59 and the first auxiliary drive source 39. Furthermore, the device includes an auxiliary electromotor 63 which is connected to the flywheel so as to maintain the flywheel at the correct speed or rev it up if necessary.

Figure 3:
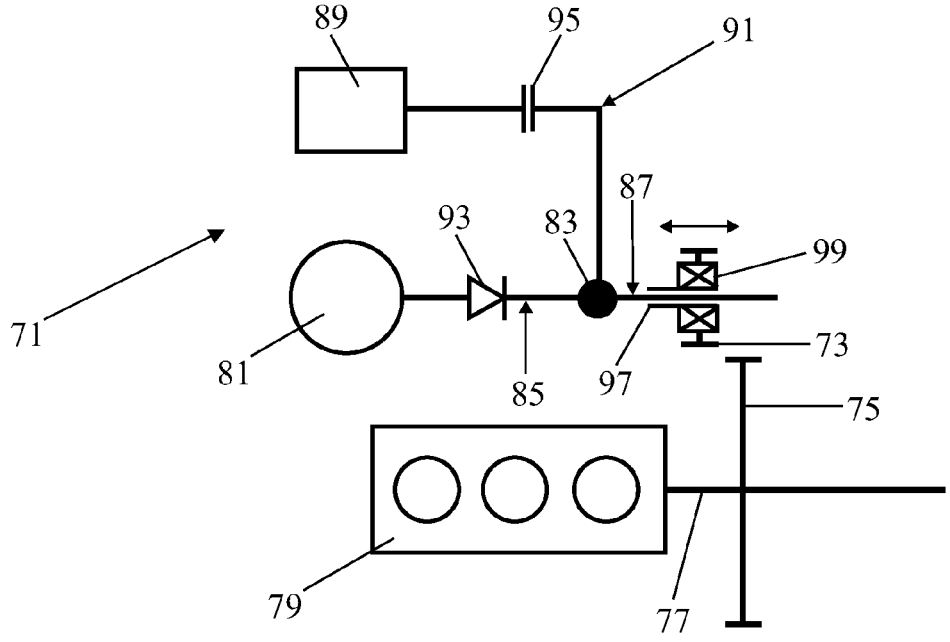
FIG. 3 shows a third embodiment of the device according to the invention.

FIG. 3 shows a third embodiment of the device for starting a combustion engine according to the invention. This device 71 has an output that is formed by a gearwheel 73 that can be coupled to a gearwheel 75 on a crankshaft 77 of a combustion engine 79. The gearwheel 73 is present there fitted on a sliding sleeve 97 that can be slid over a shaft. The sliding sleeve as well as the shaft are provided with spline teeth as a result of which they cannot be rotated relative to each other and form a sliding link.

The device comprises a first auxiliary drive source 81 which is arranged as an electromotor that is coupled to the output via a node 83. A first branch 83 of a drive line is then present between the electromotor and the node and a second branch 87 of the drive line is then present between the node and the output.

The device further includes a second auxiliary drive source 89 which is arranged as a flywheel and is coupled to the output via a node 83. A third branch 91 is then present between the flywheel and the node.

A first clutch 93 which is arranged as a freewheel bearing is present in the first branch 85 and a second clutch 95 which is arranged as a friction clutch is present in the third branch 91. A third clutch 99 which is arranged as a freewheel bearing is present in the second branch 87 and is present between the sliding bush 97 and the gearwheel 73.

Figure 4:
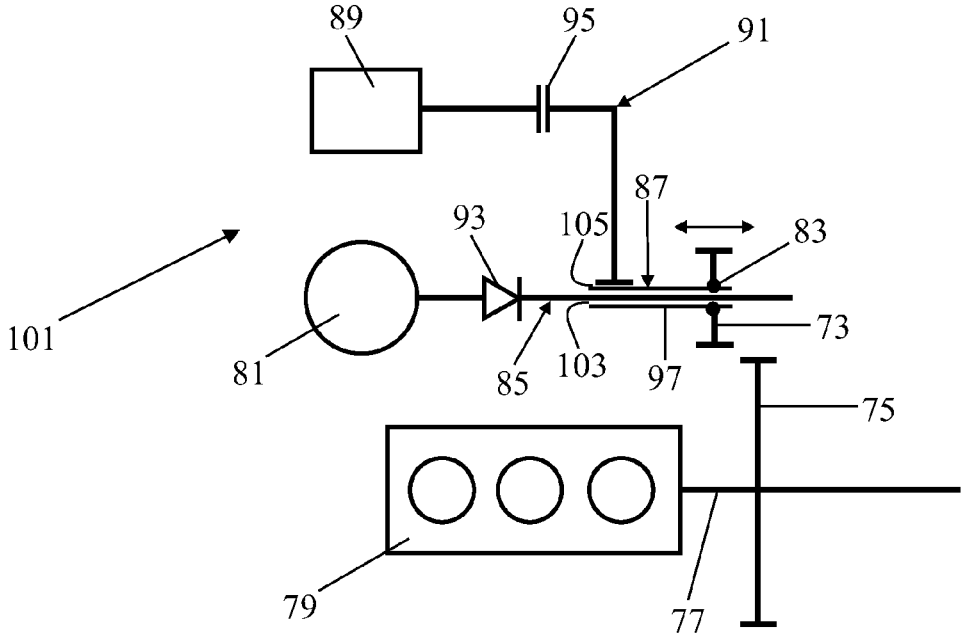
FIG. 4 shows a first variant of the third embodiment.

FIG. 4 shows a first variant of the device shown in FIG. 3. All parts that are equal to those pf the device shown in FIG. 3 are denoted by like reference numerals. In this device 101 a first sliding link 103 is present between the first auxiliary drive source 81 (electromotor) and the gearwheel 73 and a second sliding link 105 is present between the second auxiliary drive source 89 (flywheel) and the gearwheel 73. Both sliding links are arranged as spline links.

Figure 5:
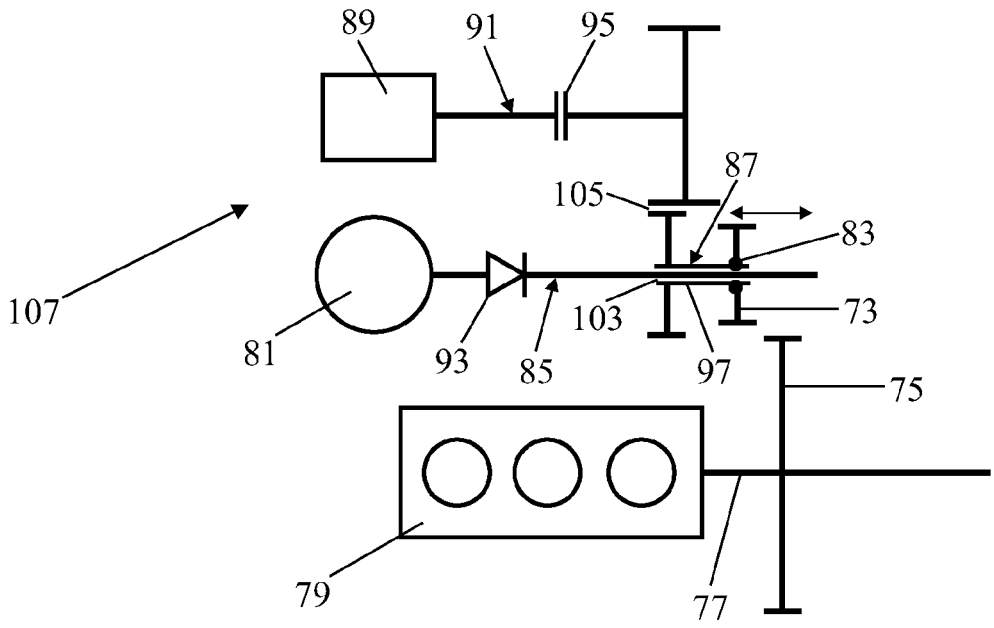
FIG. 5 shows a second variant of the third embodiment.

FIG. 5 shows a second variant of the device shown in FIG. 3. All parts that are equal to those of the device shown in FIG. 4 are denoted by like reference numerals. In this device 107 the second sliding link 105 is arranged as a gear train.

Figure 6:
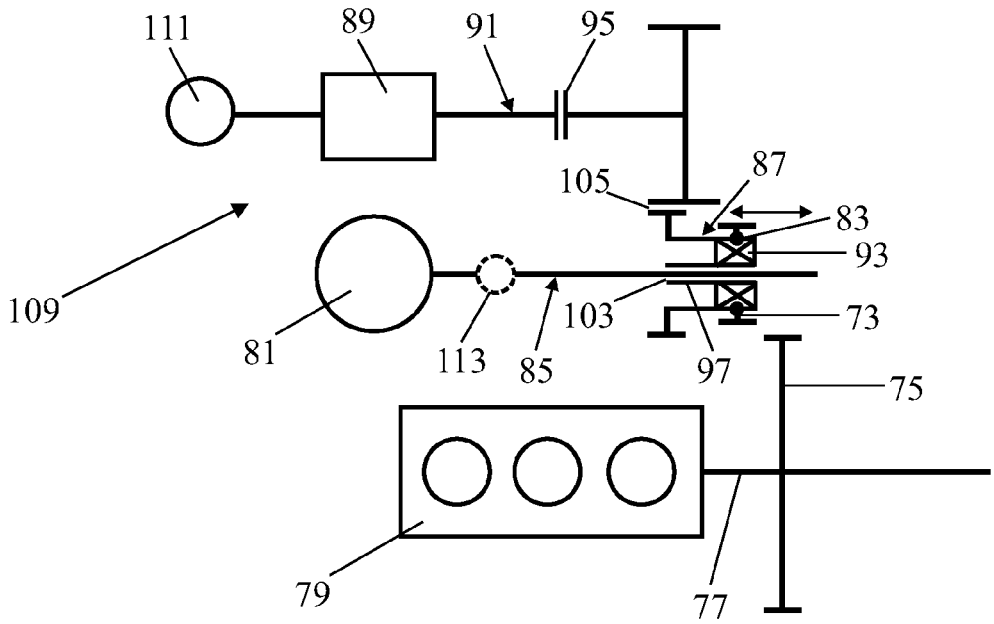
FIG. 6 shows a third variant of the third embodiment.

FIG. 6 shows a third variant of the device shown in FIG. 3. All parts that are equal to those of the device shown in FIG. 4 are denoted by like reference numerals. In this device 109 the first clutch 93 (freewheel bearing) is present between the first sliding link 103 and the gearwheel 73. Furthermore, in this device an electromotor 111 is connected to the second auxiliary drive source 89 (flywheel) and there is a reduction 113 between the electromotor and the node 83.

Albeit the invention has been described in the foregoing with reference to the drawings, it should be pointed out that the invention is not by any manner or means restricted to the embodiments shown in the drawings. The invention also extends over any embodiment deviating from the embodiment shown in the drawing Figures within the spirit and scope defined by the claims.

What is claimed is:

1. A device for starting a combustion engine having a crankshaft, the device comprising:

an output which is coupled to the crankshaft of the combustion engine when the device collaborates with the combustion engine;

a first auxiliary drive source which is coupled to the output via a node and where a first branch of a drive line is present between the first auxiliary drive source 11 and the node;

a second branch, distinct from the first branch, of the drive line is present between the node and the output;

a second auxiliary drive source which is coupled to the output via the node and where a third branch distinct from the first branch and the second branch, is present between the second auxiliary drive source and the node;

a first clutch which is present in the first branch of the drive line; and a second clutch which is present in the third branch and couples the two auxiliary drive sources to each other.

2. The device of claim 1, wherein the first auxiliary drive source is formed by an electromotor and the second auxiliary drive source is formed by a flywheel.

3. The device of claim 2, wherein the first clutch is a freewheel bearing or centrifugal decoupling and the second clutch is a friction clutch.

4. The device of claim 2, further comprising an auxiliary electromotor which is connected to the flywheel.

5. The device of claim 1, further comprising a third clutch which is arranged as a further freewheel bearing or a further centrifugal decoupling and which is present in the second branch.

6. The device of claim 5, further comprising a gear train which is present in the second branch between the node and the third clutch, and wherein a first clutch section of the third clutch is connected to one of the gearwheels of the gear train and the other clutch section forms the output.

7. The device of claim 5, wherein the third clutch is present between the sliding sleeve and the gearwheel.

8. The device of claim 1, wherein the output is formed by a gearwheel and wherein the device further comprises a sliding link which is present between a sliding sleeve to which the gearwheel is fixed and a shaft over which the sliding sleeve can slide and which sliding link can bring the gearwheel into engagement with a further gearwheel present on the crankshaft.

9. The device of claim 8, further comprising a further sliding link which is present in the third branch between the node and the second clutch, which further sliding link is formed by gearwheels of a further gear train.

10. The device of claim 1, further comprising a reduction which is present in the first branch.

* * * * *